US012219994B1

(12) United States Patent
He

(10) Patent No.: US 12,219,994 B1
(45) Date of Patent: Feb. 11, 2025

(54) ELECTRONIC CIGARETTE EQUIPPED WITH EXTERNAL LIQUID TANKS

(71) Applicant: PAX Innovations (Shenzhen) Limited, Shenzhen (CN)

(72) Inventor: Wei He, Shenzhen (CN)

( * ) Notice: Subject to any disclaimer, the term of this patent is extended or adjusted under 35 U.S.C. 154(b) by 0 days.

(21) Appl. No.: 18/672,581

(22) Filed: May 23, 2024

Related U.S. Application Data

(63) Continuation-in-part of application No. 18/623,483, filed on Apr. 1, 2024.

(51) Int. Cl.

| | |
|---|---|
| ***A24F 40/42*** | (2020.01) |
| ***A24F 40/10*** | (2020.01) |
| ***A24F 40/44*** | (2020.01) |
| ***A24F 40/485*** | (2020.01) |
| ***A24F 40/95*** | (2020.01) |
| *A24F 40/46* | (2020.01) |

(52) U.S. Cl.
CPC ..... *A24F 40/42* (2020.01); *A24F 40/10* (2020.01); *A24F 40/44* (2020.01); *A24F 40/485* (2020.01); *A24F 40/95* (2020.01); *A24F 40/46* (2020.01)

(58) Field of Classification Search
CPC ..... A24F 40/10; A24F 40/30; A24F 40/42; A24F 40/485; A24F 40/95
See application file for complete search history.

(56) References Cited

U.S. PATENT DOCUMENTS

| | | | | |
|---|---|---|---|---|
| 9,888,714 | B2 * | 2/2018 | Cameron | A24F 40/60 |
| 10,743,587 | B2 * | 8/2020 | Reevell | A24F 40/30 |
| 2014/0060556 | A1 * | 3/2014 | Liu | A24F 40/42 131/329 |
| 2016/0183592 | A1 * | 6/2016 | Liu | A24F 40/50 131/329 |

* cited by examiner

*Primary Examiner* — Hae Moon Hyeon

(57) ABSTRACT

An electronic cigarette includes an electronic cigarette main body and a plurality of liquid tanks. The liquid tanks are configured for storing tobacco liquid. The electronic cigarette main body includes a body and atomizing cores. The atomizing cores are arranged inside the body. The body is equipped with a plurality of installation cavities on sides of the atomizing cores for installing the liquid tanks. Installation openings are defined in side walls of the body for installing the liquid tanks into the installation cavities. A liquid outlet hole in communication with an interior is defined in the liquid tanks at a position near a bottom portion, and liquid inlet holes are defined in the atomizing cores. When the liquid tanks are assembled into the installation cavities, the liquid tanks are horizontally parallel to the atomizing cores, and the liquid outlet hole is in communication with the liquid inlet holes.

20 Claims, 14 Drawing Sheets

ELECTRONIC CIGARETTE EQUIPPED WITH EXTERNAL LIQUID TANKS

CROSS-REFERENCE TO RELATED APPLICATIONS

This application is a Continuation in part of the U.S. application Ser. No. 18/623,483 filed on Apr. 1, 2024, and entitled "ELECTRONIC CIGARETTE", now pending, the entire disclosures of which are incorporated herein by reference.

TECHNICAL FIELD

The present invention relates to the technical field of smoking sets, in particular to an electronic cigarette.

BACKGROUND ART

A disposable electronic cigarette has a fixed amount of tobacco liquid in an internal atomizing core. The tobacco liquid becomes less and less when used, and the tobacco liquid cannot be added. After the tobacco liquid or the electrical energy of a battery in the atomizing core is used up, a service life of the disposable electronic cigarette ends. Therefore, there is an urgent need on the market for an electronic cigarette that can be equipped with an external liquid tank to increase a capacity of the tobacco liquid.

SUMMARY

The main purpose of the present invention is to provide an electronic cigarette for solving the problem of existing disposable electronic cigarettes not being able to increase the amount of tobacco liquid.

In order to solve the above-mentioned technical problem, a technical solution is provided by the present invention.

An electronic cigarette includes an electronic cigarette main body, and a plurality of liquid tanks for storing tobacco liquid.

The electronic cigarette main body includes a body, and atomizing cores arranged inside the body. The body is equipped with a plurality of installation cavities on sides of the atomizing cores for installing the liquid tanks. Installation openings are defined in side walls of the body for installing the liquid tanks into the installation cavities.

A liquid outlet hole in communication with an interior is defined in the liquid tanks at a position near a bottom portion, and liquid inlet holes are defined in the atomizing cores.

When the liquid tanks are assembled into the installation cavities, the liquid tanks are horizontally parallel to the atomizing cores, and the liquid outlet hole is in communication with the liquid inlet holes.

Furthermore, the electronic cigarette main body further includes a circuit board, a battery, and pneumatic switches. The pneumatic switches, the battery, and the atomizing cores are all electrically connected to the circuit board. The battery, the pneumatic switches, and the circuit board are all positioned inside the body. The battery and the circuit board are both positioned below the atomizing cores, and the circuit board is positioned above the battery.

The body is equipped with first air inlet holes. The first air inlet holes are in communication with the atomizing cores.

Furthermore, a liquid passing chamber is provided inside the body. Liquid passing cavities are defined in the liquid passing chamber. The atomizing cores are arranged inside the liquid passing chamber. The liquid inlet hole is in communication with the liquid passing cavities. The installation cavities are positioned next to the liquid passing chamber.

First liquid passing holes are defined in the liquid passing chamber. The liquid outlet hole is in communication with the first liquid passing holes when the liquid tanks are assembled into the installation cavities.

Furthermore, an outside of the atomizing cores is sleeved with a first outer housing. Second liquid passing holes are defined in the first outer housing. Liquid passing cotton is arranged between the atomizing cores and the first outer housing, and the liquid passing cotton is arranged at a position corresponding to the second liquid passing holes. The liquid passing cotton covers the second liquid passing holes.

The atomizing cores include a second outer housing, liquid absorbing cotton, and a heating wire. The liquid absorbing cotton is in an annular shape, and the heating wire is arranged at a bottom portion in a middle of the liquid absorbing cotton. The liquid absorbing cotton is arranged inside the second outer housing, and the liquid inlet holes are defined in the second outer housing. Positions of the second liquid passing holes correspond to positions of the liquid inlet holes.

Furthermore, a first joint structure is provided between the liquid passing chamber and the liquid tanks. The first joint structure includes a first convex block, and a second convex block placed inside the first convex block. When the liquid tanks are assembled into the installation cavities, the second convex block is placed inside the first convex block.

Furthermore, the first convex block is positioned on the liquid tanks. The liquid outlet hole penetrates through the first convex block. The second convex block is positioned on the liquid passing chamber. The first liquid passing holes penetrate through the second convex block. The first convex block is equipped with a first sealing member for sealing the liquid outlet hole.

The first sealing member is made of rubber. The first sealing member includes a first sealing ring sleeved on the first convex block and a first sealing panel covering the first sealing ring. The first sealing panel is provided with a first indentation, and an outer contour of the second convex block is smaller than an outer contour of the liquid outlet hole.

When the second convex block is placed inside the first convex block, the second convex block squeezes the first sealing panel, so that the first sealing panel is penetrated along the first indentation. The liquid outlet hole is in communication with the first liquid passing holes. The first sealing panel is positioned between the first convex block and the second convex block.

Furthermore, a total number of the installation cavities, a total number of the liquid tanks, and a total number of the installation openings are all two. The two installation cavities are respectively positioned on opposite sides of the liquid passing chamber, and the two installation openings are positioned on opposite side walls of the body.

Furthermore, there are two atomizing cores, two liquid passing cavities, two first liquid passing holes, two second convex blocks, two pneumatic switches, and two first air inlet holes. The two liquid passing cavities are not in communication with each other. Each of the liquid passing cavities is equipped with one of the atomizing cores. Each of the liquid passing cavities is equipped with one of the liquid tanks. Each of the first air inlet holes is in communication with one of the atomizing cores, and each of the pneumatic switches is positioned between the first air inlet holes and the atomizing cores.

The electronic cigarette further includes a mouthpiece. A first aerosol outlet hole penetrates through the mouthpiece. A bottom portion of the mouthpiece extends outward to form a position limiting panel. The position limiting panel is rotatably arranged on a top portion of the body. Two second aerosol outlet holes are defined in the top portion of the body, and the two second aerosol outlet holes are respectively in communication with the two atomizing cores. When the position limiting panel rotates relative to the body, the position limiting panel is in communication with any one of the second aerosol outlet holes.

Furthermore, the body is further internally provided with a bracket. The bracket is positioned between the circuit board and the liquid passing chamber. The installation cavities are composed of the body, the bracket, and the liquid passing chamber.

The pneumatic switches are installed on the circuit board, and two first installation slots are defined in a bottom portion of the bracket. The two first installation slots are respectively in communication with one of the atomizing cores, and each of the first installation slots is internally equipped with a second sealing member. A bottom portion of the second sealing member abuts against the circuit board, and a top portion of the second sealing member abuts against a surface of the first installation slots.

The bottom portion of the second sealing member is equipped with second installation slots, and the pneumatic switches are arranged inside the second installation slots. The second sealing member and the bracket are both equipped with second air inlet holes, and the second air inlet holes are in communication with the second installation slots. A third air inlet hole in communication with the second air inlet holes is defined in the circuit board, and a fourth air inlet hole is defined in a bottom portion of the liquid passing chamber. The second air inlet holes, the third air inlet hole, the fourth air inlet holes, and an interior of the atomizing cores are in communication with each other.

The second sealing member, the bracket, and the bottom portion of the liquid passing chamber are all equipped with wiring holes.

Furthermore, the circuit board is equipped with first position limiting columns. The first position limiting columns are at least partially placed on the second sealing member.

The first position limiting columns are conductive columns. The first position limiting columns pass through the wiring holes and then are electrically connected to the atomizing cores.

Fifth air inlet holes are further defined in the second sealing member, and sixth air inlet holes are defined in the bracket. An upper end and a lower end of the fifth air inlet holes are respectively in communication with the sixth air inlet holes and the third air inlet hole, and the fifth air inlet holes are in communication with the fourth air inlet holes.

Furthermore, the liquid passing chamber includes a chamber body with openings at a bottom portion and a third sealing member arranged at the openings. The fourth air inlet holes are positioned on the third sealing member. The wiring holes penetrate through the third sealing member. Bottom portions of the atomizing cores are connected to the third sealing member. A bottom portion of the third sealing member is connected to the bracket. A fourth sealing member is arranged between top portions of the atomizing cores and the liquid passing chamber. Both the fourth sealing member and a top portion of the liquid passing chamber are equipped with third aerosol outlet holes in communication with the second aerosol outlet holes. The third aerosol outlet holes are in communication with an interior of the atomizing cores.

Furthermore, a middle of a bottom portion of the position limiting panel is provided with a convex second position limiting column. A top portion of the body is equipped with a third installation slot, and the third installation slot is adapted to the position limiting panel. A fourth sealing member is arranged inside the body at a position near the mouthpiece. A cavity is formed between the fourth sealing member and a top surface inside the body. A position limiting hole is defined in a bottom portion of the third installation slot, and the position limiting hole is in communication with the cavity. A position limiting member with a width greater than the position limiting hole is provided inside the cavity. An elastic member is arranged between the position limiting member and a top surface of the cavity. The second position limiting column passes through the position limiting hole and then is connected to the position limiting member.

Furthermore, a bottom portion of the position limiting panel is equipped with a first magnet. The third sealing member is embedded with second magnets on one side near the mouthpiece, and the second magnets are attracted with the first magnet.

Furthermore, a first air exchange hole is defined in a top portion or near the top portion of the liquid tanks, and the first air exchange hole is in communication with the liquid passing chamber when the liquid tanks are installed in the installation cavities.

Furthermore, a second joint structure is provided between the liquid tanks and the liquid passing chamber. The second joint structure includes a third convex block and a fourth convex block placed inside the third convex block. The fourth convex block is placed inside the third convex block when the liquid tanks are assembled into the installation cavities.

Furthermore, the third convex block is positioned on the liquid tanks. The first air exchange hole penetrates through the third convex block. The fourth convex block is positioned on the liquid passing chamber. A second air exchange hole in communication with the liquid passing chamber penetrates through the fourth convex block.

The third convex block is provided with a fifth sealing member for sealing the first air exchange hole.

Furthermore, the fifth sealing member is made of rubber, and the fifth sealing member includes a second sealing ring sleeved on the third convex block and a second sealing panel covering the second sealing ring. The second sealing panel is provided with a second indentation, and an outer contour of the fourth convex block is smaller than a size of the first air exchange hole.

When the fourth convex block is placed inside the third convex block, the fourth convex block squeezes the second sealing panel, so that the second sealing panel is penetrated along the second indentation, achieving communication between the first air exchange hole and the second air exchange hole. The second sealing panel is positioned between the third convex block and the fourth convex block.

Furthermore, the liquid tanks include a tank body and a tank cover. The tank cover is connected to the tank body. A third sealing member is provided between the tank cover and the tank body.

At least one fixing block is provided at a top portion and/or a bottom portion of the liquid tanks, and one side surface of the fixing block near the liquid outlet hole is at least partially inclined.

Furthermore, the circuit board is equipped with a charging interface, and the battery is a charging battery. An avoidance opening is defined in the body at a position corresponding to the charging interface.

Furthermore, the body includes an upper cover body, an intermediate housing body, and a bottom housing. The upper cover body and the bottom housing are respectively connected to an upper end and a lower end of the intermediate housing body. The battery and the circuit board are arranged in the bottom housing. The atomizing cores are arranged in a middle of the intermediate housing body. The bottom housing is equipped with a display screen. The installation openings are defined in the intermediate housing body, and the charging interface is positioned on the bottom housing.

When the liquid tanks are assembled into the installation cavities, the fixing block is engaged with the intermediate housing body and placed inside the intermediate housing body.

Compared with the prior art, in the present invention, the installation cavities are reserved on the electronic cigarette main body for subsequent installation of the liquid tanks. Therefore, when the liquid tanks are assembled into the installation cavities, tobacco liquid in the liquid tanks can be placed in the atomizing cores after passing through the liquid outlet hole and the liquid inlet holes, thereby adding tobacco liquid to the atomizing cores inside the electronic cigarette main body, so as to increase a total number of puffs of the electronic cigarette and extend a service life of the electronic cigarette main body. Moreover, in this embodiment, the installation openings are defined in the side walls of the body. Therefore, when a user needs to add tobacco liquid, the liquid tanks can be assembled into the installation cavities from the installation openings in the side walls of the body, making it convenient for the user to assemble.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
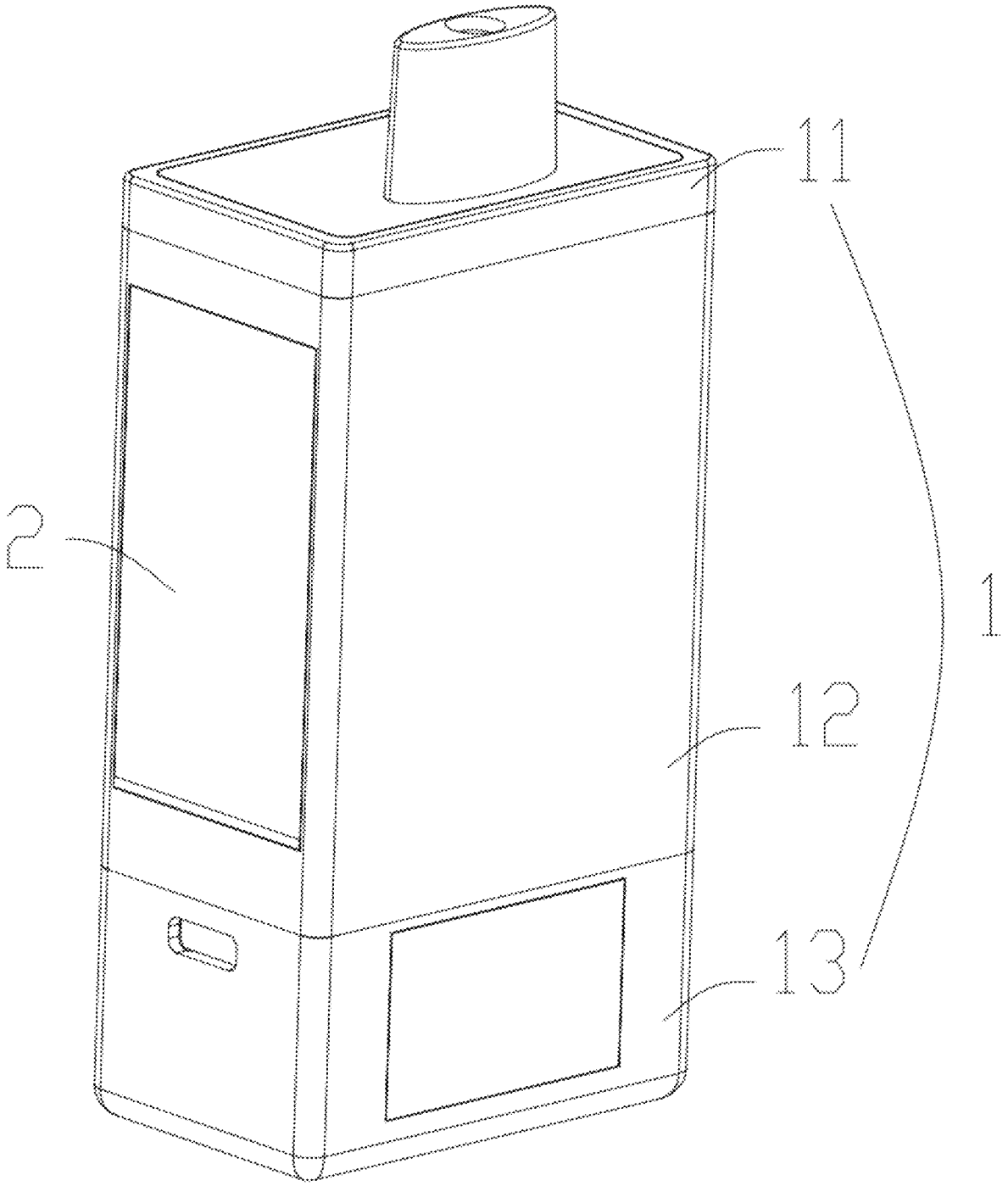
FIG. 1 is a perspective view according to the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
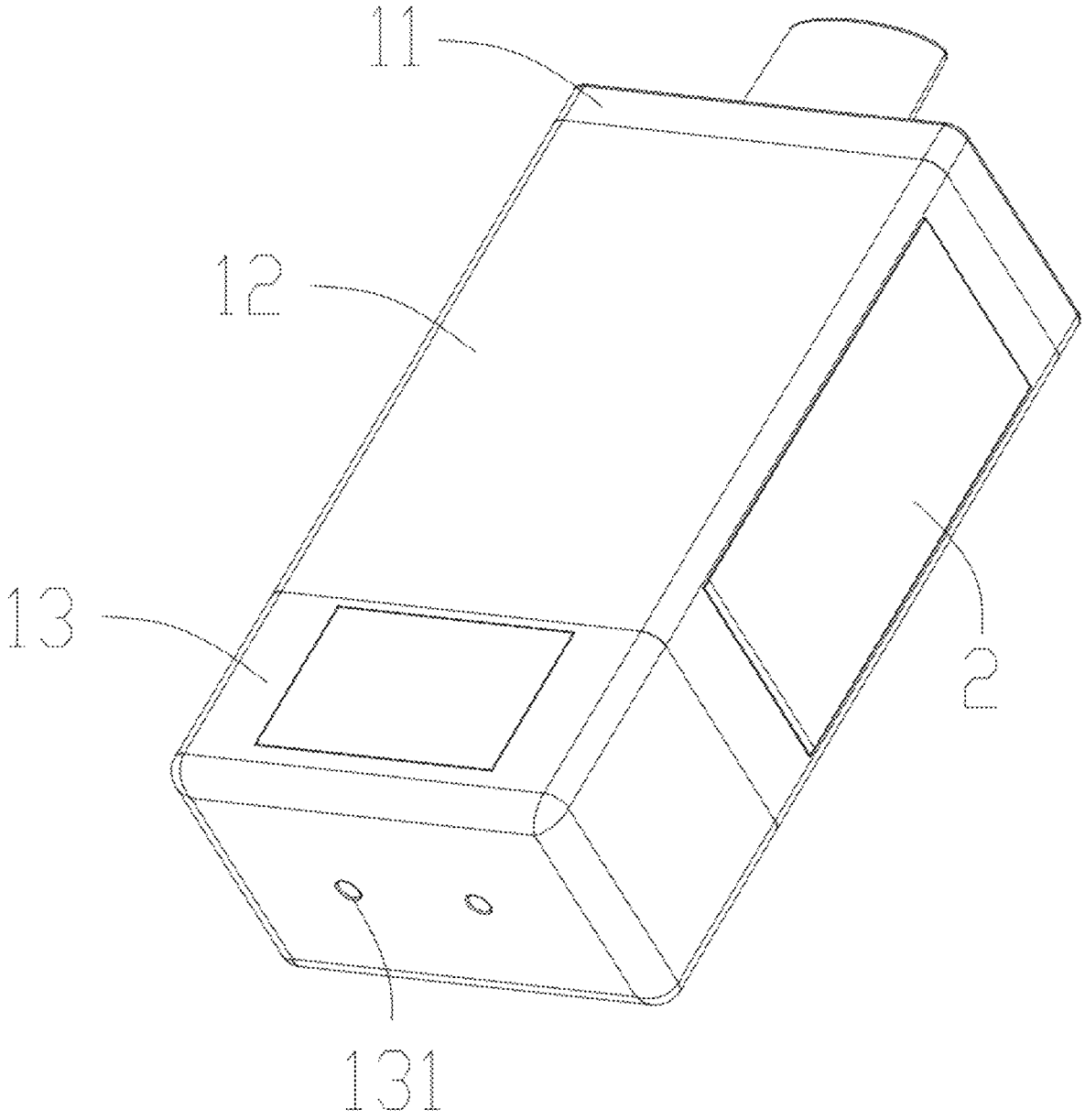
FIG. 2 is a perspective view from another perspective according to the present invention.
Figure 3:
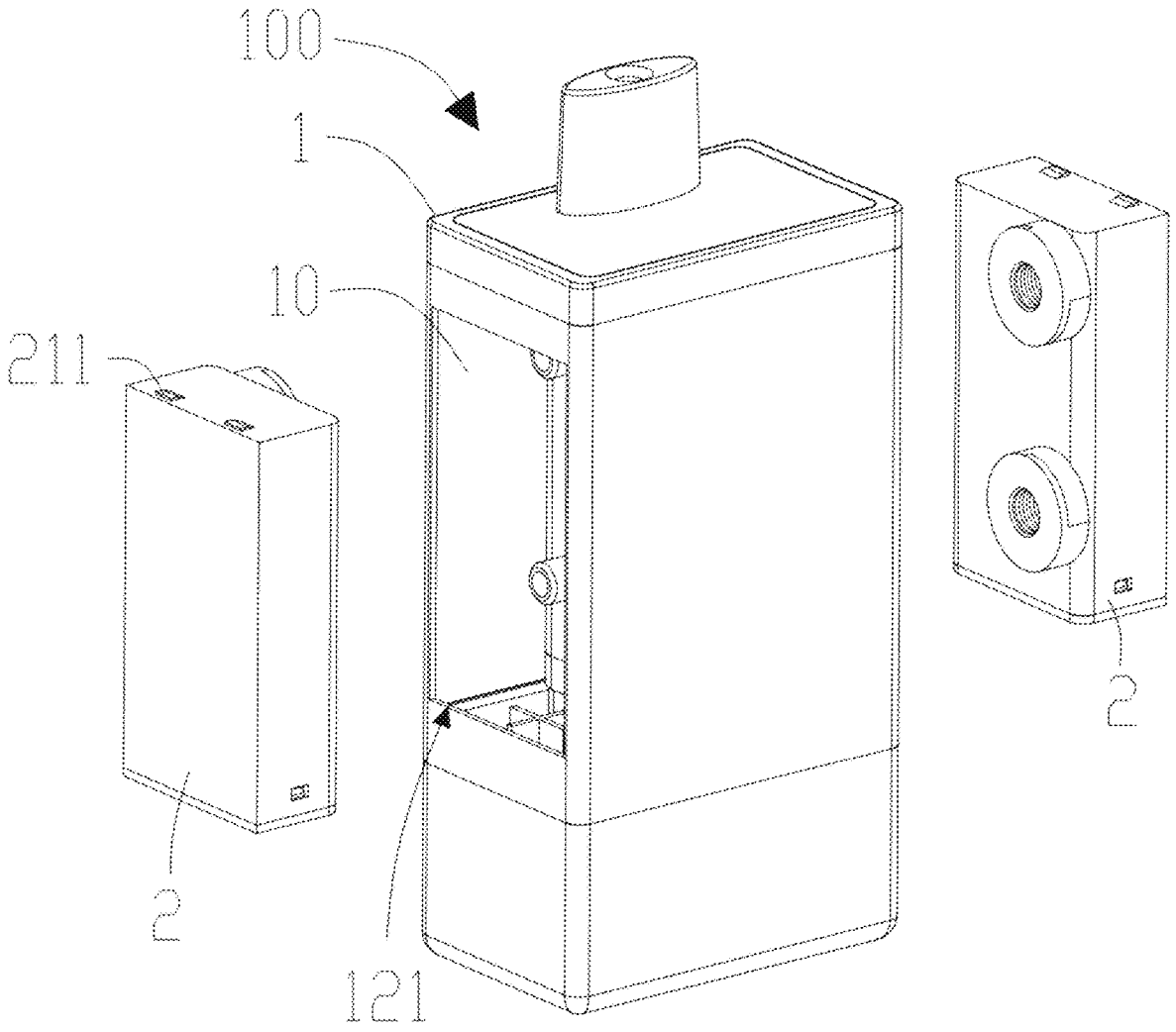
FIG. 3 is an exploded view of an electronic cigarette main body and liquid tanks according to the present invention.
Figure 4:
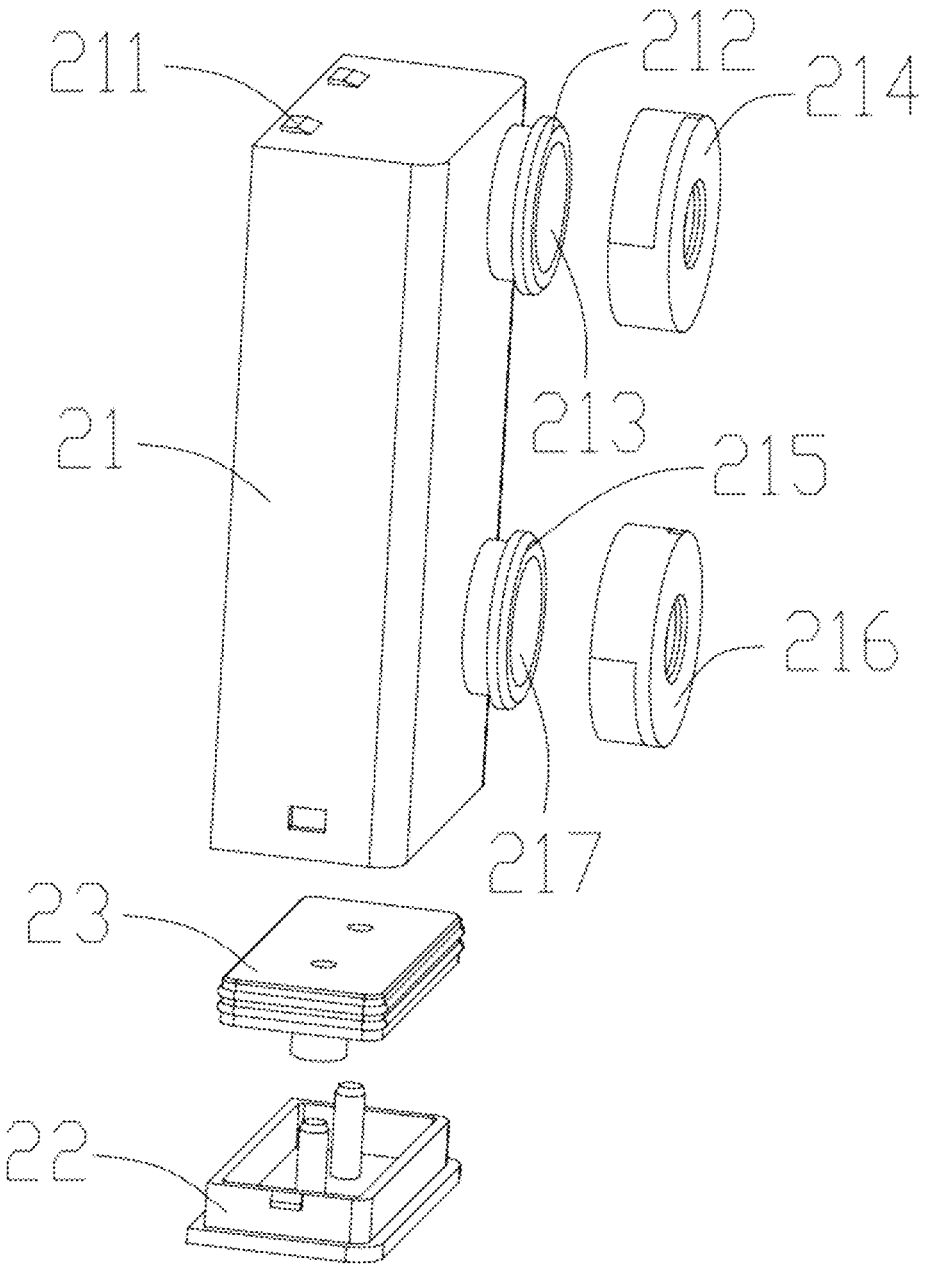
FIG. 4 is an exploded view of a liquid tank according to the present invention.
Figure 5:
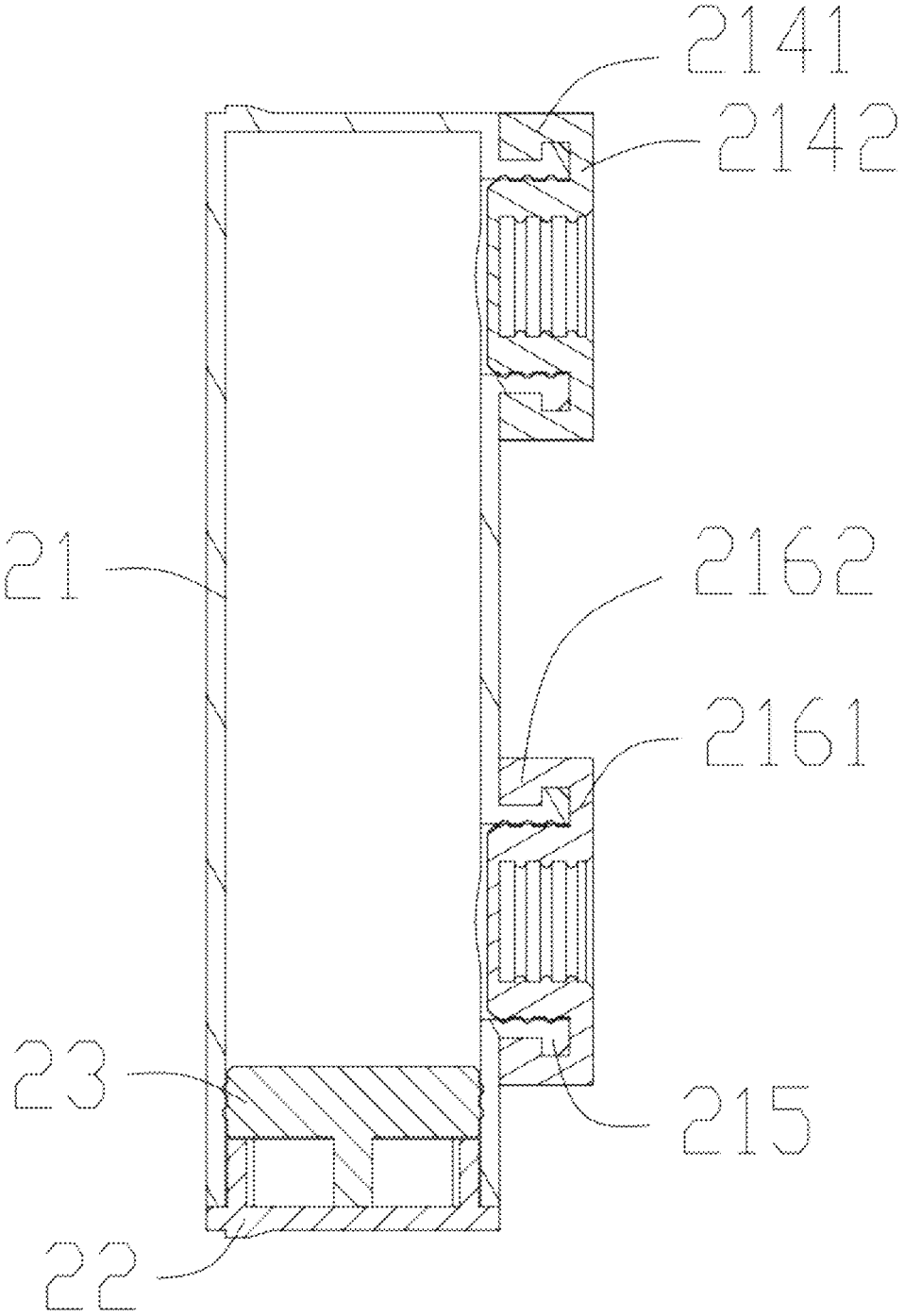
FIG. 5 is a cross-sectional view of a liquid tank along a center line of a liquid outlet hole according to the present invention.
Figure 6:
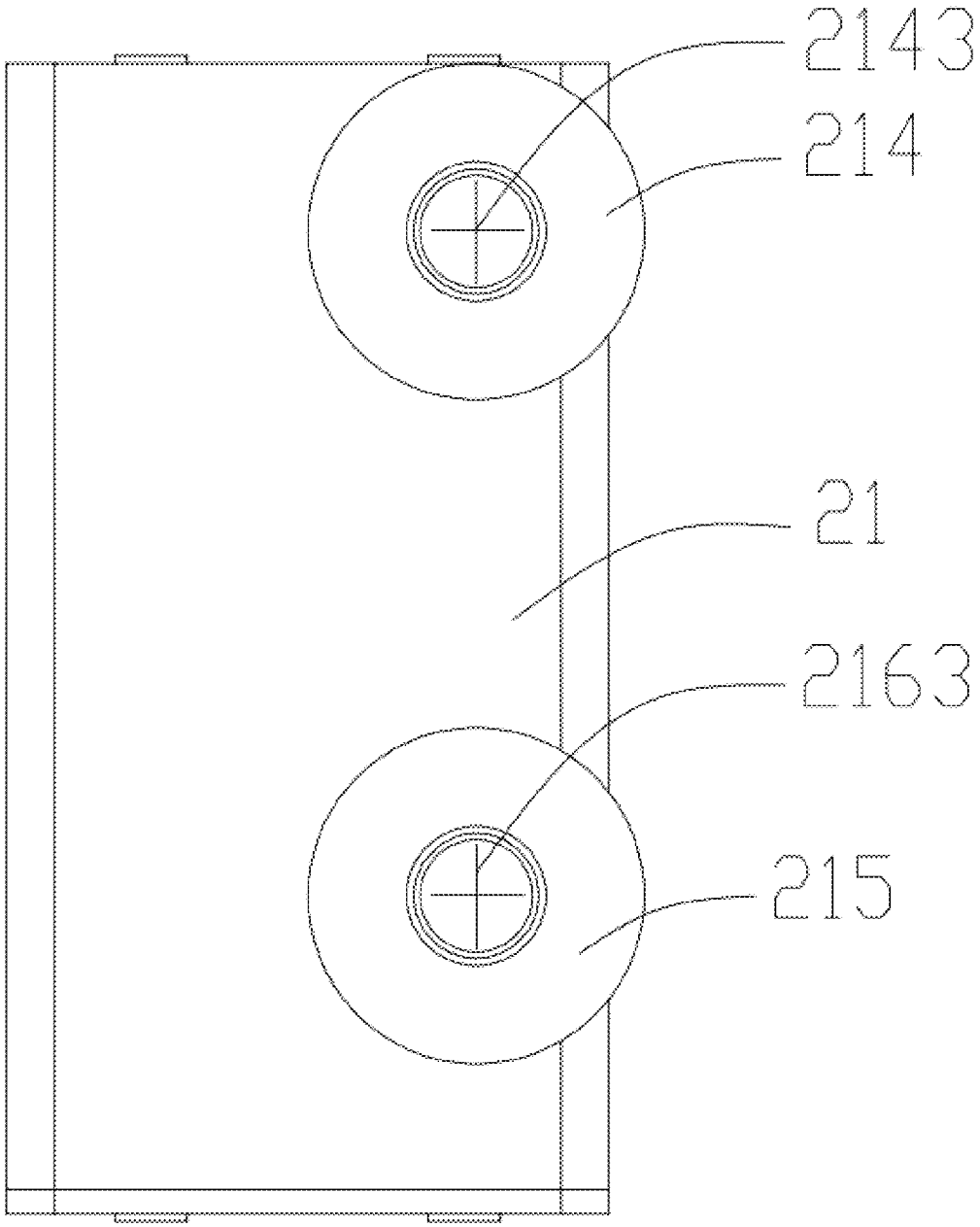
FIG. 6 is a front view of a liquid tank according to the present invention.
Figure 7:
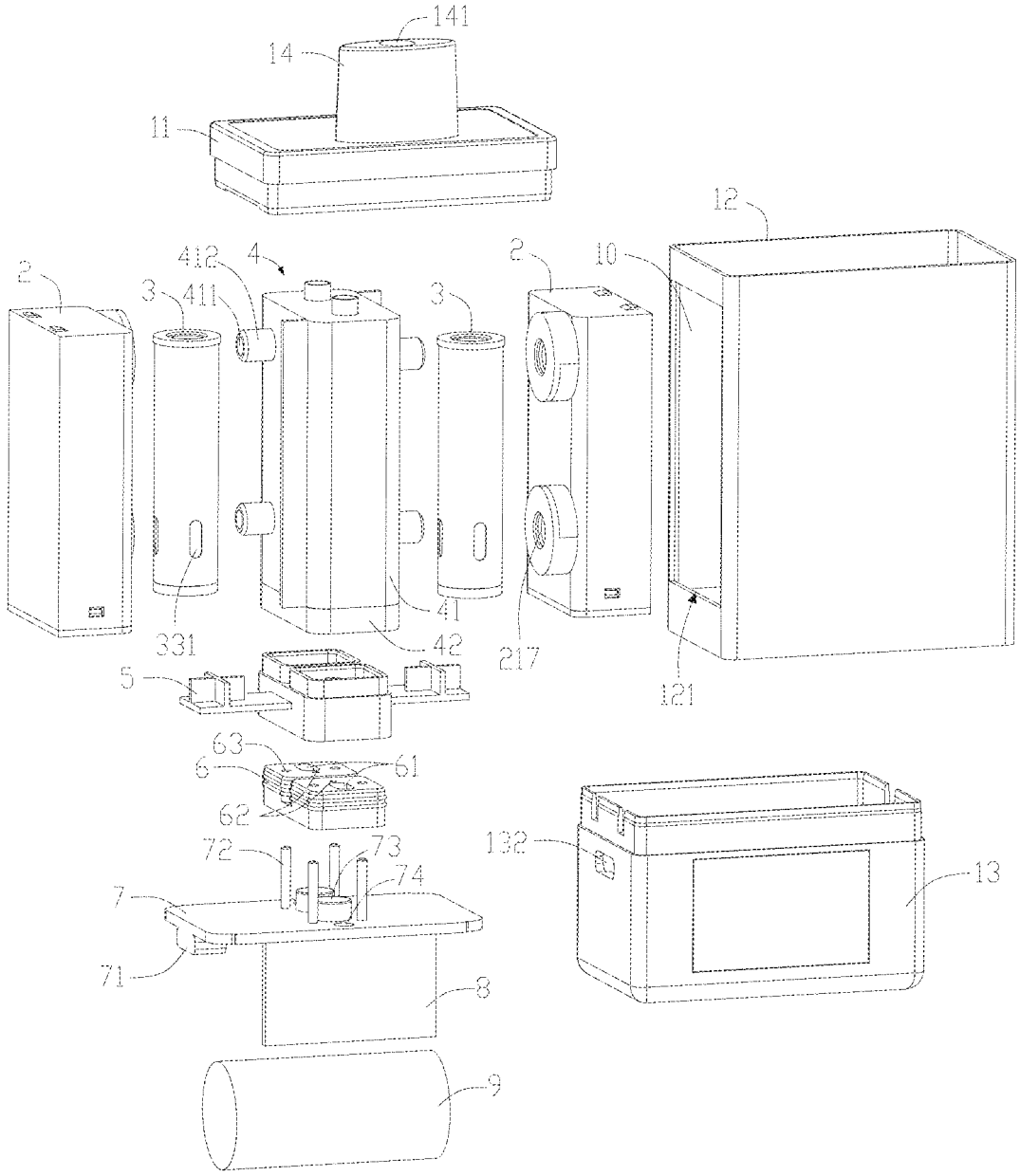
FIG. 7 is an exploded view according to the present invention.
Figure 8:
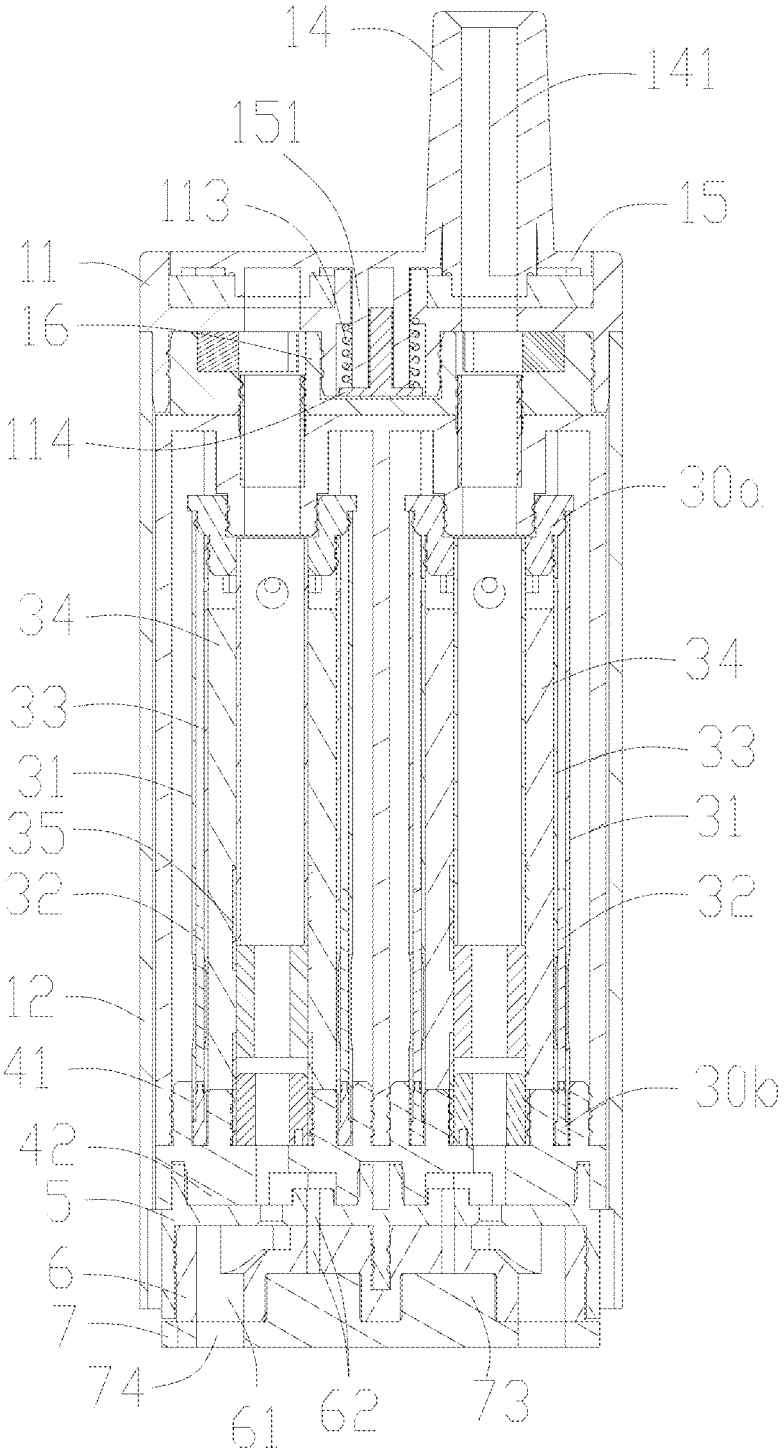
FIG. 8 is a partial cross-sectional view along a center line of a first aerosol outlet hole according to the present invention.
Figure 9:
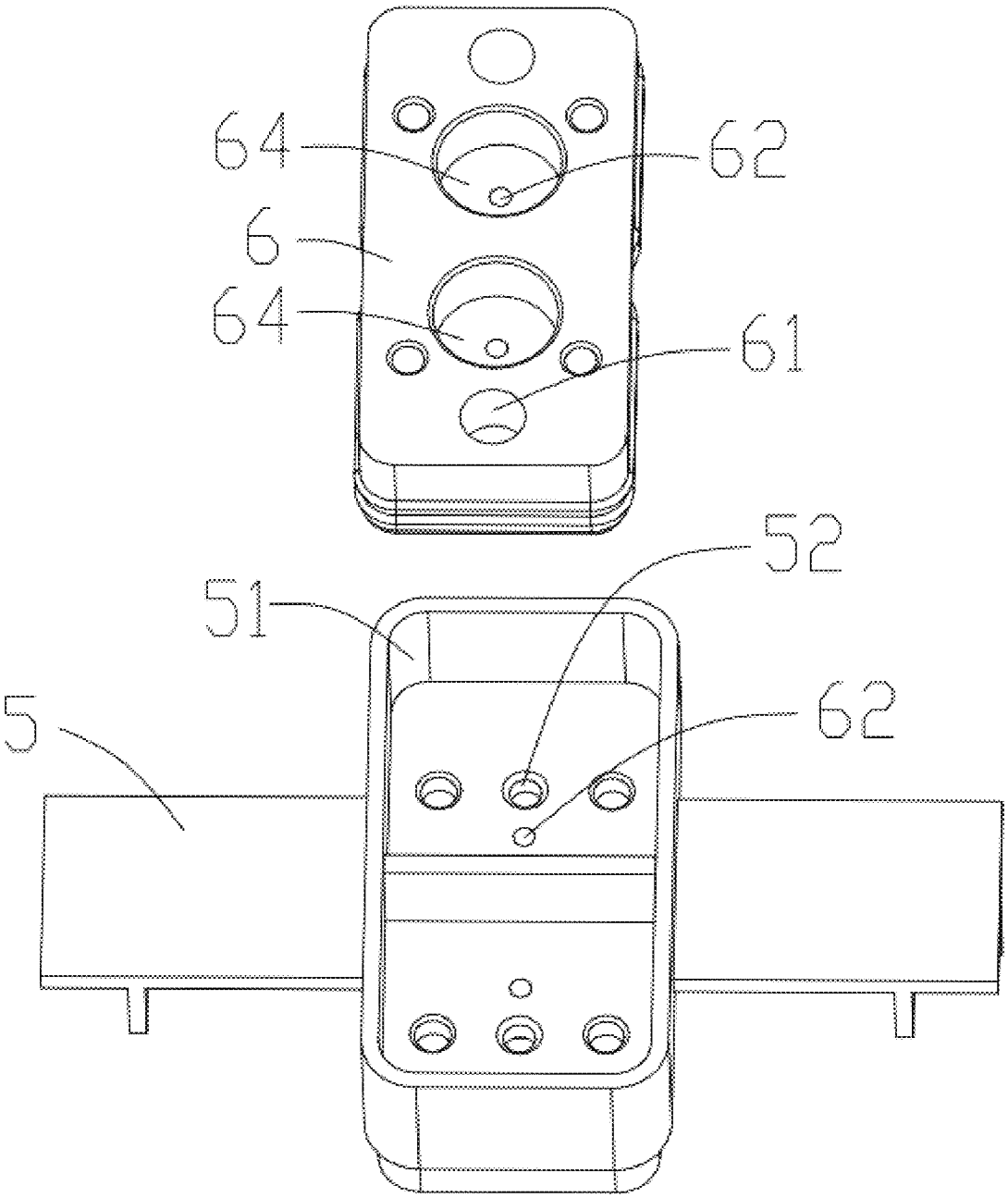
FIG. 9 is an exploded view of a bracket and a second sealing member according to the present invention.
Figure 10:
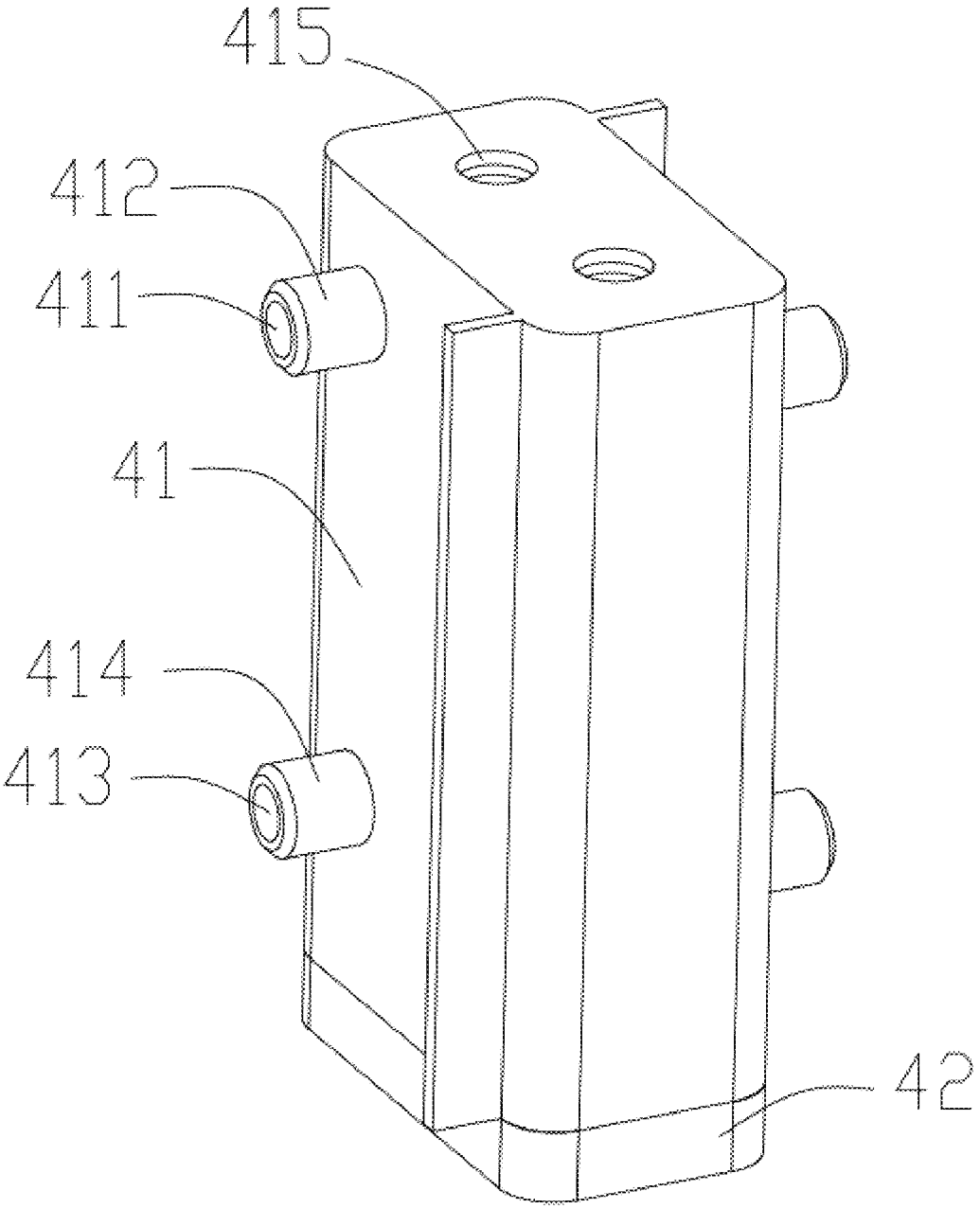
FIG. 10 is a perspective view of a liquid passing chamber according to the present invention.
Figure 11:
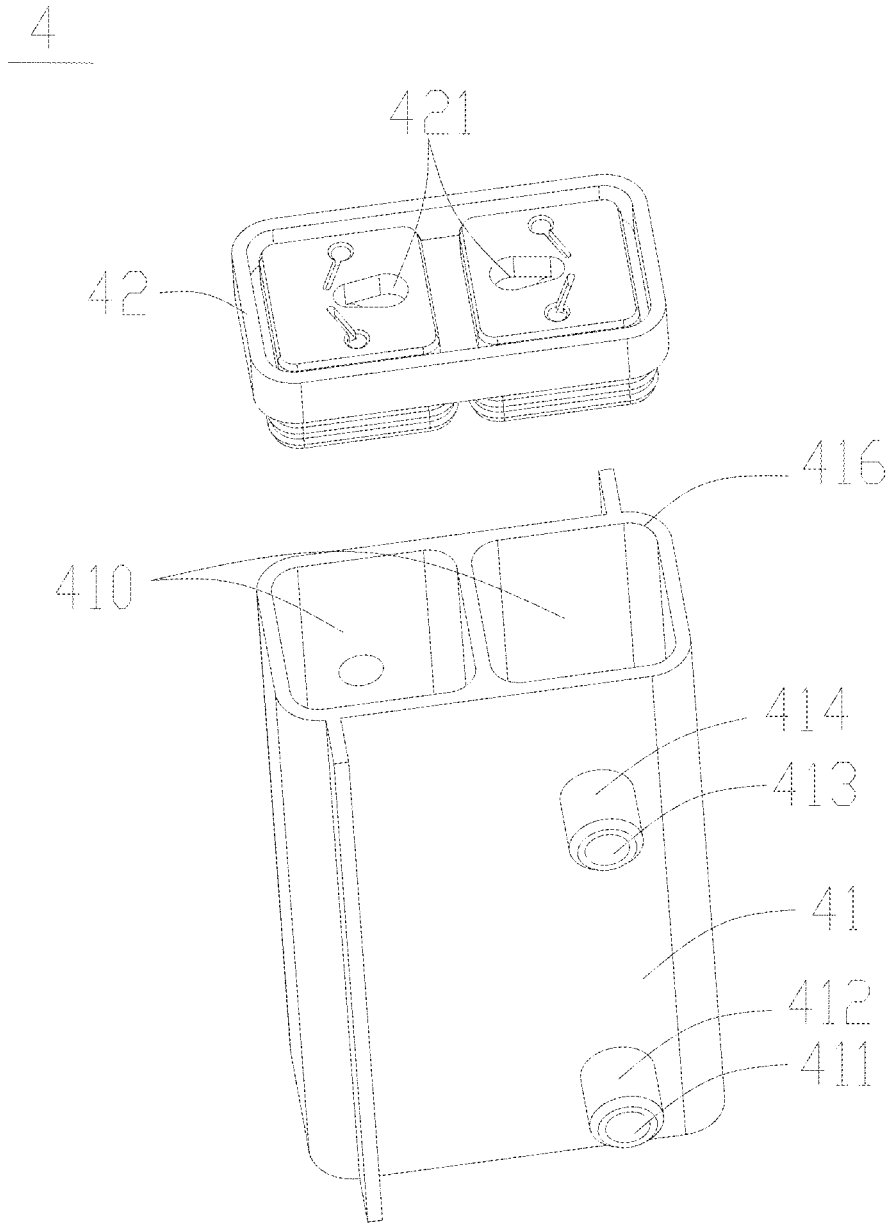
FIG. 11 is an exploded view of a liquid passing chamber according to the present invention.
Figure 12:
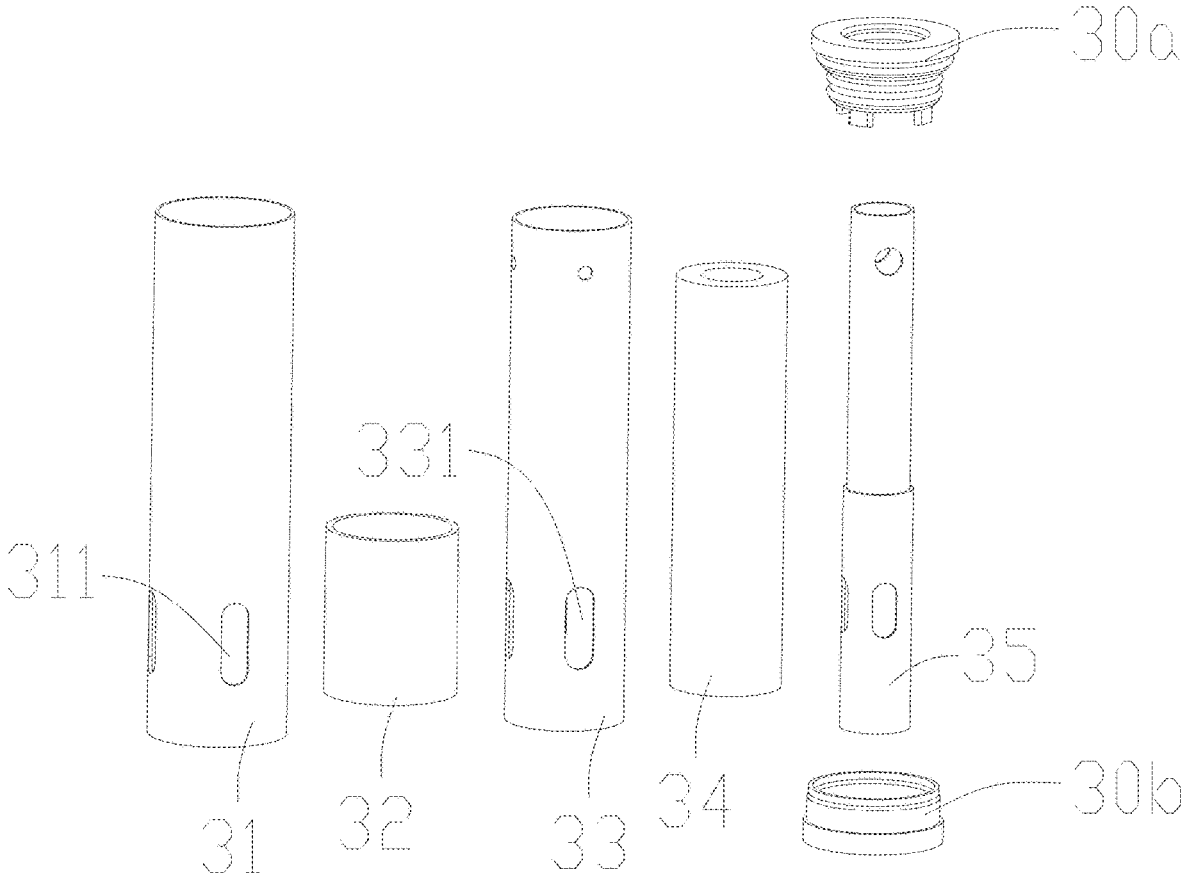
FIG. 12 is an exploded view of an atomizing core, a first outer housing, and liquid passing cotton according to the present invention.
Figure 13:
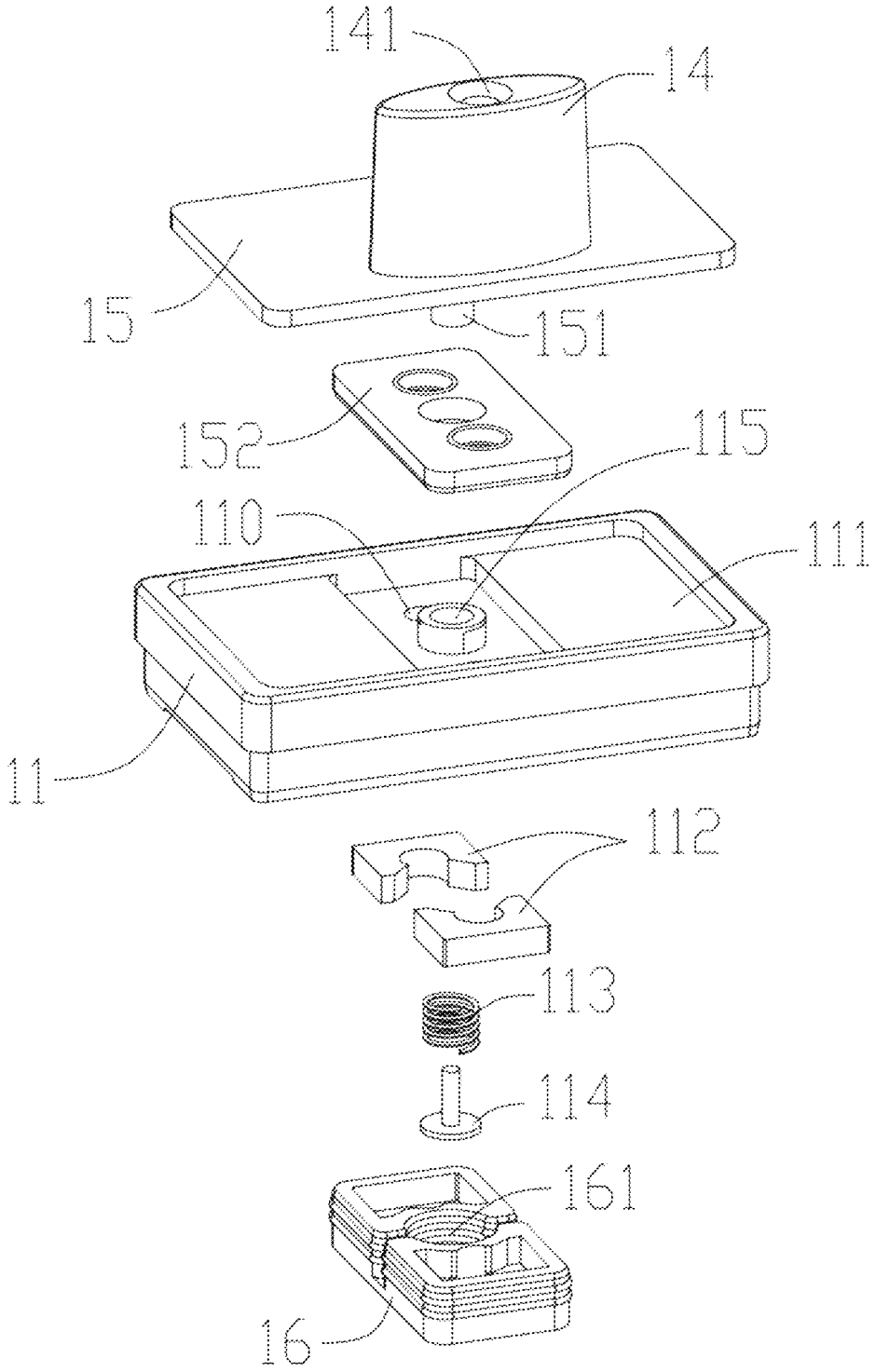
FIG. 13 is a partially exploded view according to the present invention.
Figure 14:
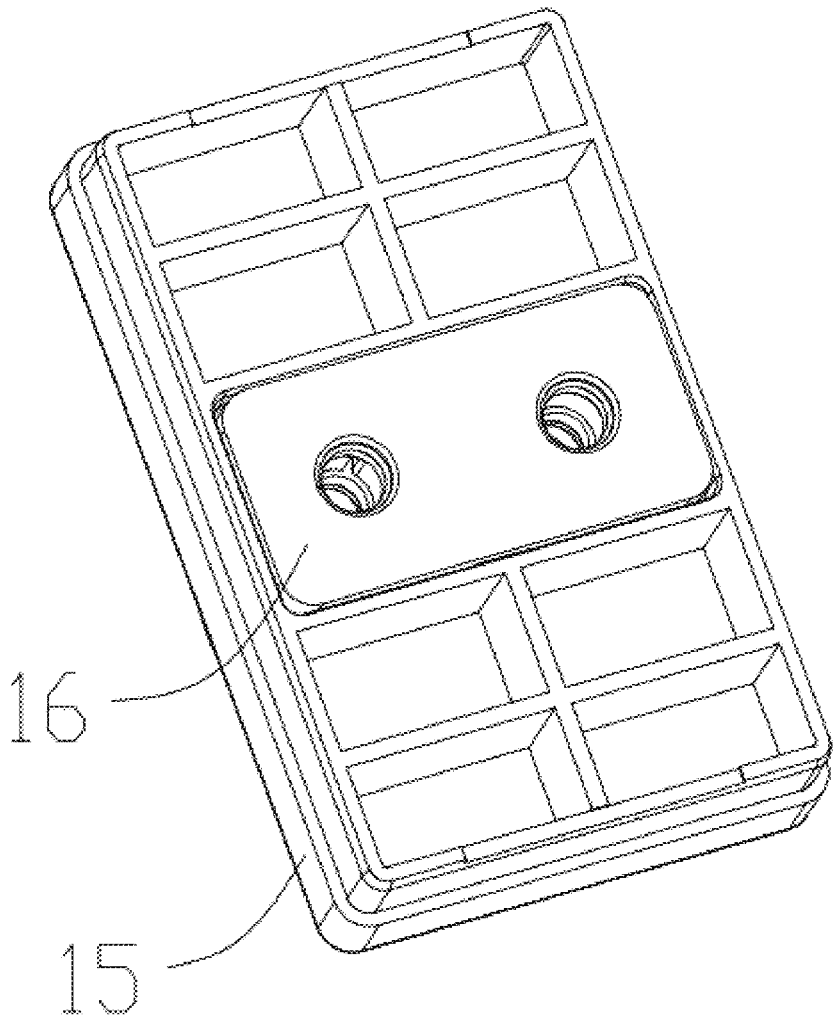
FIG. 14 is an assembled diagram of an upper cover body and a fourth sealing member according to the present invention.

FIGS. 1-14 show an electronic cigarette according to an embodiment of the present invention.

The electronic cigarette includes an electronic cigarette main body 100 and a plurality of liquid tanks 2. The liquid tanks 2 are configured for storing tobacco liquid. The electronic cigarette main body 100 includes a body 1 and atomizing cores 3. The atomizing cores 3 are arranged inside the body 1. The body 1 is equipped with a plurality of installation cavities 10 on sides of the atomizing cores 3 for installing the liquid tanks 2. Installation openings 121 are defined in side walls of the body 1 for installing the liquid tanks 2 into the installation cavities 10. A liquid outlet hole 217 in communication with an interior is defined in the liquid tanks 2 at a position near a bottom portion, and liquid inlet holes 331 are defined in the atomizing cores 3. When the liquid tanks 2 are assembled into the installation cavities 10, the liquid tanks 2 are horizontally parallel to the atomizing cores 3, and the liquid outlet hole 217 is in communication with the liquid inlet holes 331.

In this embodiment, the installation cavities 10 are reserved on the electronic cigarette main body 100 for subsequent installation of the liquid tanks 2. Therefore, when the liquid tanks 2 are assembled into the installation cavities 10, tobacco liquid in the liquid tanks 2 can be placed in the atomizing cores 3 after passing through the liquid outlet hole 217 and the liquid inlet holes 331, thereby adding tobacco liquid to the atomizing cores 3 inside the electronic cigarette main body 100, so as to increase a total number of puffs of the electronic cigarette and extend a service life of the electronic cigarette main body 100. Moreover, in this embodiment, the installation openings 121 are defined in the side walls of the body 1. Therefore, when a user needs to add tobacco liquid, the liquid tanks 2 can be assembled into the installation cavities 10 from the installation openings 121 in the side walls of the body 1, making it convenient for the user to assemble.

Specifically, in one embodiment, at the time of leaving the factory, the liquid outlet hole 217 can be sealed with paper or a layer of film to prevent the leakage of tobacco liquid. The liquid tanks 2 can be integrally formed by injection molding. Alternatively, in other embodiments, the liquid tanks 2 can include a tank body 21 and a tank cover 22. The tank cover 22 is connected to the tank body 21. A third sealing member 23 is provided between the tank cover 22 and the tank body 21 to achieve sealing of the liquid tanks 2. The tank cover 22 is connected to the tank body 21 through buckles, screws, threads, ultrasonic welding, or glue.

In one embodiment, at least one fixing block 211 is provided at a top portion and/or a bottom portion of the liquid tanks 2. One side surface of the fixing block 211 near the liquid outlet hole 217 is at least partially inclined. Moreover, an outer contour of the liquid tanks 2 fits with the installation openings 121. Therefore, when the liquid tanks 2 are placed in the installation cavities 10, the fixing block 211 is engaged with a peripheral side of the installation openings 121, that is, the fixing block 211 is engaged with the body 1 to achieve fixation of the liquid tanks 2. Of course, in other embodiments, the liquid tanks 2 can also be fixed to the installation cavities 10 through interference fit, or assembled in the installation cavities 10 through pasting, etc. An assembly method of the liquid tanks 2 is not limited here.

In this embodiment, the electronic cigarette main body 100 further includes a circuit board 7, a battery 9, and pneumatic switches 73. The pneumatic switches 73, the battery 9, and the atomizing cores 3 are all electrically connected to the circuit board 7. The battery 9 is configured for providing power to the circuit board 7. The battery 9, the pneumatic switches 73, and the circuit board 7 are all positioned inside the body 1. The battery 9 and the circuit board 7 are both positioned below the atomizing cores 3, and the circuit board 7 is positioned above the battery 9 to reduce a volume of a cross-section of the electronic cigarette main body 100. The body 1 is equipped with first air inlet holes 131. The first air inlet holes 131 are in communication with the atomizing cores 3 to generate airflow when the user smokes. The air enters from the first air inlet holes 131, and the pneumatic switches 73 detect a difference in air pressure and feed back an electrical signal to the circuit board 7. The circuit board 7 drives the atomizing cores 3 to work based on this electrical signal, so as to atomize the tobacco liquid. When no change in air pressure is detected by the pneumatic switches 73, the circuit board 7 does not drive the atomizing cores 3 to work, so that the electronic cigarette works in an orderly manner.

Of course, in other embodiments, the circuit board 7 and the battery 9 can also be horizontally arranged in parallel with the atomizing cores 3, and a specific position between the circuit board 7, the battery 9, and the atomizing cores 3 is not limited here.

In practical application, a liquid passing chamber 4 is provided inside the body 1. Liquid passing cavities 410 are defined in the liquid passing chamber 4. The atomizing cores 3 are arranged inside the liquid passing chamber 4. The liquid inlet hole 331 is in communication with the liquid passing cavities 410. The installation cavities 10 are positioned next to the liquid passing chamber 4. First liquid passing holes 413 are defined in the liquid passing chamber 4. The liquid outlet hole 217 is in communication with the first liquid passing holes 413 when the liquid tanks 2 are assembled into the installation cavities 10. Due to the small and precise structure and volume of the atomizing cores 3, it is difficult to install a conduit or other structures on the atomizing cores 3, and the production costs will increase. Based on this, the liquid passing cavities 410 are configured for transitioning the tobacco liquid from the liquid tanks 2 to the atomizing cores 3, so as to facilitate the production and manufacture of the electronic cigarette.

In one embodiment, an outside of the atomizing cores 3 is sleeved with a first outer housing 31. Second liquid passing holes 311 are defined in the first outer housing 31. Liquid passing cotton 32 is arranged between the atomizing cores 3 and the first outer housing 31, and the liquid passing cotton 32 is arranged at a position corresponding to the second liquid passing holes 311. The liquid passing cotton 32 covers the second liquid passing holes 311. By configuring the liquid passing cotton 32 between the atomizing cores 3 and the first outer housing 31, the tobacco liquid in the liquid tanks 2 can be discharged from the liquid outlet hole 217 and then enter the atomizing cores 3 through the liquid passing cotton 32 and the liquid inlet holes 331. The liquid passing cotton 32 is also capable of blocking excessive tobacco liquid from entering the atomizing cores 3, preventing the tobacco liquid in the atomizing cores 3 being excessive and preventing the user from inhaling the tobacco liquid into the mouth while puffing.

The atomizing cores 3 include a top sealing cover **30*a*, a bottom sealing ring 30*b*, a second outer housing 33, liquid absorbing cotton 34, and a heating wire 35. The top sealing cover 30*a* and the bottom sealing ring 30*b* are installed on two opposite ends of the second outer housing 33. The liquid absorbing cotton 34 is in an annular shape, and the heating wire 35 is arranged at a bottom portion in a middle of the liquid absorbing cotton 34. The liquid absorbing cotton 34 is arranged inside the second outer housing 33, and the liquid inlet holes 331 are defined in the second outer housing 33. By using the liquid absorbing cotton 34 to adsorb the tobacco liquid, when the liquid tanks 2 are not installed, the tobacco liquid in the atomizing cores 3 can be prevented from leaking out. Under the tobacco liquid's own gravity, the tobacco liquid will converge towards a bottom portion of the liquid absorbing cotton 34, so that when the heating wire 35** heats up, the tobacco liquid can be atomized.

In one embodiment, positions of the liquid inlet holes 331 correspond to positions of the second liquid passing holes 311 for liquid inlet. Of course, in other embodiments, the positions of the liquid inlet holes 331 can be misaligned with the positions of the second liquid passing holes 311.

In one embodiment, a total number of the second liquid passing holes 311 and a total number of the liquid inlet holes 331 are both multiple. Of course, in other embodiments, the total number of the second liquid passing hole 311 and the total number of the liquid inlet hole 331 can be one.

In the above embodiments, a first joint structure is provided between the liquid passing chamber 4 and the liquid tanks 2. The first joint structure includes a first convex block 215, and a second convex block 414 placed inside the first convex block 215. When the liquid tanks 2 are assembled into the installation cavities 10, the second convex block 414 is placed inside the first convex block 215, so that the liquid tanks 2 are stably assembled into the installation cavities 10.

Specifically, the first convex block 215 is positioned on the liquid tanks 2. The liquid outlet hole 217 penetrates through the first convex block 215. The second convex block 414 is positioned on the liquid passing chamber 4. The first liquid passing holes 413 penetrate through the second convex block 414. The first convex block 215 is equipped with a first sealing member 216 for sealing the liquid outlet hole 217. Moreover, when the second convex block 414 is placed inside the first convex block 215, the first sealing member 216 can communicate the liquid outlet hole 217 with the first liquid passing holes 413.

In one embodiment, the first sealing member 216 is made of rubber. The first sealing member 216 includes a first sealing ring 2162 sleeved on the first convex block 215 and a first sealing panel 2161 covering the first sealing ring 2162. The first sealing panel 2161 is provided with a first indentation 2163, and an outer contour of the second convex block 414 is smaller than an outer contour of the liquid outlet hole 217. When the second convex block 414 is placed inside the first convex block 215, the second convex block 414 squeezes the first sealing panel 2161, so that the first sealing panel 2161 is penetrated along the first indentation 2163. The liquid outlet hole 217 is in communication with the first liquid passing holes 413. The first sealing panel 2161 is positioned between the first convex block 215 and the second convex block 414, allowing the tobacco liquid in the liquid tanks 2 to enter the liquid passing cavities 410 through the liquid outlet hole 217 and the first liquid passing holes 413.

In other embodiments, the first sealing member 216 can also be directly placed inside the liquid outlet hole 217. When the second convex block 414 is placed inside the first convex block 215, the first sealing member 216 can be pushed away to achieve the communication between the liquid outlet hole 217 and the first liquid passing holes 413.

In the above embodiments, a total number of the installation cavities 10 can be two, three, four, etc., and the total number of the installation cavities 10 is not limited here.

In one embodiment, the total number of the installation cavities 10, a total number of the liquid tanks 2, and a total number of the installation openings 121 are all two. The two installation cavities 10 are respectively positioned on opposite sides of the liquid passing chamber 4, and the two installation openings 121 are positioned on opposite side walls of the body 1. That is, the electronic cigarette main body 100 can be equipped with two liquid tanks 2 simultaneously for use, and the liquid tanks 2 are symmetrically configured to improve the overall aesthetics of the electronic cigarette.

In one embodiment, there are two atomizing cores 3, two liquid passing cavities 410, two first liquid passing holes 413, two second convex blocks 414, two pneumatic switches 73, and two first air inlet holes 131. The two liquid passing cavities 410 are not in communication with each other. Each of the liquid passing cavities 410 is equipped with one of the atomizing cores 3. Each of the liquid passing cavities 410 is equipped with one of the liquid tanks 2. Each of the first air inlet holes 131 is in communication with one of the atomizing cores 3. Each of the pneumatic switches 73 is positioned between the first air inlet holes 131 and the atomizing cores 3. The electronic cigarette further includes a mouthpiece 14. A first aerosol outlet hole 141 penetrates through the mouthpiece 14. A bottom portion of the mouthpiece 14 extends outward to form a position limiting panel 15. The first aerosol outlet hole 141 penetrates through the position limiting panel 15. The position limiting panel 15 is rotatably arranged on a top portion 11 of the body 1. Two second aerosol outlet holes 110 are defined in the top portion 11 of the body 1, and the two second aerosol outlet holes 110 are respectively in communication with the two atomizing cores 3. When the position limiting panel 15 rotates relative to the body 1, the position limiting panel 15 is in communication with any one of the second aerosol outlet holes 110. Therefore, the two atomizing cores 3 can be configured with different flavors, bringing more experiences to the user. Moreover, by configuring a mouthpiece 14 and rotatably connecting the position limiting panel 15 to the body 1, the user can switch different atomizing cores 3 to use, and the configuration of the mouthpiece 14 is reduced, making it convenient for the user to use.

In one embodiment, a middle of a bottom portion of the position limiting panel 15 is provided with a convex second position limiting column 151. The top portion 11 of the body 1 is equipped with a third installation slot 111, and the third installation slot 111 is adapted to the position limiting panel 15. A fourth sealing member 16 is arranged inside the body 1 at a position near the mouthpiece 14. A cavity 161 is formed between the fourth sealing member 16 and a top surface inside the body 1. A position limiting hole 115 is defined in a bottom portion of the third installation slot 111, and the position limiting hole 115 is in communication with the cavity 161. A position limiting member 114 with a width greater than the position limiting hole 115 is provided inside the cavity 161. An elastic member 113 is arranged between the position limiting member 114 and a top surface of the cavity 161. The second position limiting column 151 passes through the position limiting hole 115 and then is connected to the position limiting member 114. The user can pull the mouthpiece 14 upwards to drive the position limiting panel 15 and position limiting member 114 to move upwards. The elastic member 113 is compressed, and the position limiting panel 15 can rotate 180 degrees after leaving the third installation slot 111. Then, the mouthpiece 14 is released. Under the restore action of the elastic member 113, the position limiting panel 15 is placed inside the third installation slot 111. The third installation slot 111 is used to limit a position of the position limiting panel 15, so that the position limiting panel 15 can be prevented from rotating.

In a preferred embodiment, a bottom portion of the position limiting panel 15 can be equipped with a first magnet 152. The third sealing member 23 is embedded with second magnets 112 on one side near the mouthpiece 14, and the second magnets 112 are attracted with the first magnet 152. Through the attraction between the first magnet 152 and the second magnets 112, the position limiting on the position limiting panel 15 can be improved, and the tactile sensation of pulling the mouthpiece 14 can also be improved.

Specifically, the elastic member 113 is a spring, and the elastic member 113 is sleeved on an outer side of the second position limiting column 151. Alternatively, the elastic member 113 can also be an elastic sheet, which can also achieve elastic support and restore after being compressed.

In other embodiments, a magnet can also be directly configured at a bottom portion of the position limiting panel 15, and another magnet can be configured on the body 1. By using the two magnets to attract with each other, the positioning of the position limiting panel 15 can also be achieved when the position of the position limiting panel 15 changes. When the mouthpiece 14 is lifted, the two magnets do not attract with each other, the position limiting panel 15 is detached from the body 1, and the atomizing cores 3 can also be switched for use.

In one embodiment, when a total number of the installation cavities 10 is multiple, the body 1 is further internally provided with a bracket 5. The bracket 5 is positioned between the circuit board 7 and the liquid passing chamber 4. The installation cavities 10 are composed of the body 1, the bracket 5, and the liquid passing chamber 4. By utilizing the bracket 5 and the body 1, a height of the installation cavities 10 can be limited.

The pneumatic switches 73 are installed on the circuit board 7, and two first installation slots 51 are defined in a bottom portion of the bracket 5. The two first installation slots 51 are respectively in communication with one of the atomizing cores 3, and each of the first installation slots 51 is internally equipped with a second sealing member 6. A bottom portion of the second sealing member 6 abuts against the circuit board 7, and a top portion of the second sealing member 6 abuts against a surface of the first installation slots 51. The bottom portion of the second sealing member 6 is equipped with second installation slots 64, and the pneumatic switches 73 are arranged inside the second installation slots 64. The second sealing member 6 and the bracket 5 are both equipped with second air inlet holes 62, and the second air inlet holes 62 are in communication with the second installation slots 64. A third air inlet hole 74 is defined in the circuit board 7, and a fourth air inlet hole 421 is defined in a bottom portion of the liquid passing chamber 4. The second air inlet holes 62, the third air inlet hole 74, the fourth air inlet holes 421, and an interior of the atomizing cores 3 are in communication with each other. In this way, when the user puffs through the mouthpiece 14, the airflow enters from the first air inlet hole 131 then passes through the third air inlet hole 74 and the second air inlet holes 62, and then an air pressure difference can be detected by the pneumatic switches 73. Based on this, the circuit board 7 drives the heating wire 35 to heat up and atomizes the tobacco liquid into aerosol. After the airflow passes through the atomizing cores 3, the aerosol is carried out through the second aerosol outlet holes 110 and the first aerosol outlet hole 141, so that the aerosol is inhaled by the user.

Specifically, the second sealing member 6, the bracket 5, and the bottom portion of the liquid passing chamber 4 are all equipped with wiring holes 63. The wiring holes 63 are used for wires to pass through, and the wires are configured for the electrical connection between the heating wire 35 and the circuit board 7, thereby achieving the electrical connection between the heating wire 35 and the circuit board 7.

In one embodiment, the circuit board 7 is equipped with first position limiting columns 72. The first position limiting columns 72 are at least partially placed on the second sealing member 6 to limit a position of the second sealing member 6.

In one embodiment, the first position limiting columns 72 are conductive columns. The first position limiting columns 72 pass through the wiring holes 63 and then are electrically connected to the atomizing cores 3 to reduce the configuration of holes.

In one embodiment, the second air inlet holes 62, the third air inlet hole 74, and the fourth air inlet holes 421 are on an identical straight line. In other embodiments, fifth air inlet holes 61 are further defined in the second sealing member 6, and sixth air inlet holes 52 are defined in the bracket 5. An upper end and a lower end of the fifth air inlet holes 61 are respectively in communication with the sixth air inlet holes 52 and the third air inlet hole 74, and the fifth air inlet holes 61 are in communication with the fourth air inlet holes 421, thereby allowing the pneumatic switches 73 to detect an airflow difference. Moreover, by configuring the fifth air inlet holes 61, an incoming airflow can be increased, improving the smoothness of the user's puffing and enhancing the user experience of the electronic cigarette.

In one embodiment, the liquid passing chamber 4 includes a chamber body 41 with openings 416 at a bottom portion and the third sealing member 42 arranged at the openings 416. The fourth air inlet holes 421 are positioned on the third sealing member 42. The wiring holes 63 penetrate through the third sealing member 42. Bottom portions of the atomizing cores 3 are connected to the third sealing member 42. A bottom portion of the third sealing member 42 is connected to the bracket 5. A fourth sealing member 16 is arranged between top portions of the atomizing cores 3 and the liquid passing chamber 4. Both the fourth sealing member 16 and a top portion of the liquid passing chamber 4 are equipped with third aerosol outlet holes 415, and the third aerosol outlet holes 415 are in communication with the second aerosol outlet holes 110. The third aerosol outlet holes 415 are in communication with an interior of the atomizing cores 3. By using the third sealing member 42 and the fourth sealing member 16, the atomizing cores 3 can be sealed, with only holes reserved for airflow to pass through, thereby preventing liquid leakage.

In one embodiment, a first air exchange hole 213 is defined in a top portion or near the top portion of the liquid tanks 2. The first air exchange hole 213 is in communication with the liquid passing chamber 4 when the liquid tanks 2 are installed in the installation cavities 10. When the liquid outlet hole 217 is relatively small, when the tobacco liquid flows from a closed space, that is, when the tobacco liquid flows to the liquid outlet hole 217, a film will form on the liquid outlet hole 217 to block the liquid outlet hole 217, affecting the flow of the tobacco liquid from the liquid outlet hole 217. Therefore, the first air exchange hole 213 is defined in the liquid tanks 2 to improve the smoothness of the flow of the tobacco liquid and prevent the tobacco liquid from forming the film in the liquid outlet hole 217.

In one embodiment, a second joint structure is provided between the liquid tanks 2 and the liquid passing chamber 4. The second joint structure includes a third convex block 212 and a fourth convex block 412 placed inside the third convex block 212. The fourth convex block 412 is placed inside the third convex block 212 when the liquid tanks 2 are assembled into the installation cavities 10. By using this structure, the liquid tanks 2 can be more stably assembled into the installation cavities 10.

Specifically, the third convex block 212 is positioned on the liquid tanks 2. The first air exchange hole 213 penetrates through the third convex block 212. The fourth convex block 412 is positioned on the liquid passing chamber 4. A second air exchange hole 411 in communication with the liquid passing chamber 4 penetrates through the fourth convex block 412. The third convex block 212 is provided with a fifth sealing member 214 for sealing the first air exchange hole 213. Moreover, when the fourth convex block 412 is placed inside the third convex block 212, the fifth sealing member 214 can communicate the first air exchange hole 213 with the second air exchange hole 411. By using the second air exchange hole 411 to communicate with an interior of the liquid passing chamber 4, and through the first air exchange hole 213, a liquid cavity can be in communication with external gas to improve the fluidity of the tobacco liquid.

In one embodiment, the fifth sealing member 214 is made of rubber, and the fifth sealing member 214 includes a second sealing ring 2141 sleeved on the third convex block 212 and a second sealing panel 2142 covering the second sealing ring 2141. The second sealing panel 2142 is provided with a second indentation 2143, and an outer contour of the fourth convex block 412 is smaller than a size of the first air exchange hole 213. When the fourth convex block 412 is placed inside the third convex block 212, the fourth convex block 412 squeezes the second sealing panel 2142, so that the second sealing panel 2142 is penetrated along the second indentation 2143, achieving communication between the first air exchange hole 213 and the second air exchange hole 411. Moreover, the second sealing panel 2142 is positioned between the third convex block 212 and the fourth convex block 412. Thus, top portions of the liquid tanks 2 are in communication with external gas through the liquid passing chamber 4 and the atomizing cores 3.

Of course, in other embodiment, a size of the liquid outlet hole 217 can also be increased to allow smooth flow of the tobacco liquid.

In one embodiment, the circuit board 7 is equipped with a charging interface 71, and the battery 9 is a charging battery. An avoidance opening 132 is defined in the body 1 at a position corresponding to the charging interface 71. By using the charging interface 71 to connect to the power supply, the battery 9 can be charged through the circuit board 7. Specifically, the charging interface 71 can be a USB-C interface, a USB-A interface, etc.

In one embodiment, the body 1 is equipped with a display screen 8. The display screen 8 is electrically connected to the circuit board 7. The display screen 8 can be used for displaying an electrical quantity of the battery 9, a working mode of the circuit board 7, etc., playing an indication role.

In one embodiment, the body 1 includes an upper cover body 11, an intermediate housing body 12, and a bottom housing 13. The upper cover body 11 and the bottom housing 13 are respectively connected to an upper end and a lower end of the intermediate housing body 12. The battery 9 and the circuit board 7 are arranged in the bottom housing 13. The atomizing cores 3 are arranged in a middle of the intermediate housing body 12. The installation cavities 10 is composed of the intermediate housing body 12, the bracket 5, the liquid passing chamber 4, and the upper cover body 11. The display screen 8 is positioned on the bottom housing 13. The installation openings 121 are defined in the intermediate housing body 12, and the charging interface 71 is positioned on the bottom housing 13. The second aerosol outlet holes 110, the third installation slot 111, and the third sealing member 23 are all positioned on the upper cover body 11. A buckle is engaged with the intermediate housing body 12. The body 1 is formed by the above structure, facilitating production and manufacturing, facilitating the assembly of internal components, and increasing the color configuration of the electronic cigarette, thereby enhancing the aesthetics of the product and meeting an appearance need of the user.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. An electronic cigarette, comprising an electronic cigarette main body, and a plurality of liquid tanks for storing tobacco liquid;

wherein the electronic cigarette main body comprises a body, and atomizing cores arranged inside the body; the body is equipped with a plurality of installation cavities on sides of the atomizing cores for installing the liquid tanks, and installation openings are defined in side walls of the body for installing the liquid tanks into the installation cavities;

a liquid outlet hole in communication with an interior is defined in the liquid tanks at a position near a bottom portion of the liquid tanks, and liquid inlet holes are defined in the atomizing cores;

when the liquid tanks are assembled into the installation cavities, the liquid tanks are horizontally parallel to the atomizing cores, and the liquid outlet hole is in communication with the liquid inlet holes.

2. The electronic cigarette of claim 1, wherein the electronic cigarette main body further comprises a circuit board, a battery, and pneumatic switches; the pneumatic switches, the battery, and the atomizing cores are all electrically connected to the circuit board; the battery, the pneumatic switches, and the circuit board are all positioned inside the body; the battery and the circuit board are both positioned below the atomizing cores, and the circuit board is positioned above the battery;

the body is equipped with first air inlet holes, and the first air inlet holes are in communication with the atomizing cores.

3. The electronic cigarette of claim 2, wherein a liquid passing chamber is provided inside the body, liquid passing cavities are defined in the liquid passing chamber, the atomizing cores are arranged inside the liquid passing chamber, the liquid inlet hole is in communication with the liquid passing cavities, and the installation cavities are positioned next to the liquid passing chamber;

first liquid passing holes are defined in the liquid passing chamber, and the liquid outlet hole is in communication with the first liquid passing holes when the liquid tanks are assembled into the installation cavities.

4. The electronic cigarette of claim 3, wherein an outside of the atomizing cores is sleeved with a first outer housing, second liquid passing holes are defined in the first outer housing, liquid passing cotton is arranged between the atomizing cores and the first outer housing, the liquid passing cotton is arranged at a position corresponding to the second liquid passing holes, and the liquid passing cotton covers the second liquid passing holes;

the atomizing cores comprise a second outer housing, liquid absorbing cotton, and a heating wire; the liquid absorbing cotton is in an annular shape, the heating wire is arranged at a bottom portion in a middle of the liquid absorbing cotton, the liquid absorbing cotton is arranged inside the second outer housing, the liquid inlet holes are defined in the second outer housing, and positions of the second liquid passing holes correspond to positions of the liquid inlet holes.

5. The electronic cigarette of claim 3, wherein a first joint structure is provided between the liquid passing chamber and the liquid tanks; the first joint structure comprises a first convex block, and a second convex block placed inside the first convex block; and when the liquid tanks are assembled into the installation cavities, the second convex block is placed inside the first convex block.

6. The electronic cigarette of claim 5, wherein the first convex block is positioned on the liquid tanks, the liquid outlet hole penetrates through the first convex block, the second convex block is positioned on the liquid passing chamber, and the first liquid passing holes penetrate through the second convex block; the first convex block is equipped with a first sealing member for sealing the liquid outlet hole;

the first sealing member is made of rubber, the first sealing member comprises a first sealing ring sleeved on the first convex block and a first sealing panel covering the first sealing ring; the first sealing panel is provided with a first indentation, and an outer contour of the second convex block is smaller than an outer contour of the liquid outlet hole;

when the second convex block is placed inside the first convex block, the second convex block squeezes the first sealing panel, so that the first sealing panel is penetrated along the first indentation, the liquid outlet hole is in communication with the first liquid passing holes, and the first sealing panel is positioned between the first convex block and the second convex block.

7. The electronic cigarette of claim 1, wherein a total number of the installation cavities, a total number of the liquid tanks, and a total number of the installation openings are all two; the two installation cavities are respectively positioned on opposite sides of the liquid passing chamber, and the two installation openings are positioned on opposite side walls of the body.

8. The electronic cigarette of claim 7, wherein there are two atomizing cores, two liquid passing cavities, two first liquid passing holes, two second convex blocks, two pneumatic switches, and two first air inlet holes; the two liquid passing cavities are not in communication with each other, each of the liquid passing cavities is equipped with one of the atomizing cores, each of the liquid passing cavities is equipped with one of the liquid tanks, each of the first air inlet holes is in communication with one of the atomizing cores, and each of the pneumatic switches is positioned between the first air inlet holes and the atomizing cores;

the electronic cigarette further comprises a mouthpiece, a first aerosol outlet hole penetrates through the mouthpiece, a bottom portion of the mouthpiece extends outward to form a position limiting panel, and the position limiting panel is rotatably arranged on a top portion of the body; two second aerosol outlet holes are defined in the top portion of the body, and the two second aerosol outlet holes are respectively in communication with the two atomizing cores; and when the position limiting panel rotates relative to the body, the position limiting panel is in communication with any one of the second aerosol outlet holes.

9. The electronic cigarette of claim 8, wherein the body is further internally provided with a bracket, the bracket is positioned between the circuit board and the liquid passing chamber, and the installation cavities are composed of the body, the bracket, and the liquid passing chamber;

the pneumatic switches are installed on the circuit board, two first installation slots are defined in a bottom portion of the bracket, the two first installation slots are respectively in communication with one of the atomizing cores, each of the first installation slots is internally equipped with a second sealing member, a bottom portion of the second sealing member abuts against the circuit board, and a top portion of the second sealing member abuts against a surface of the first installation slots;

the bottom portion of the second sealing member is equipped with second installation slots, and the pneumatic switches are arranged inside the second installation slots; the second sealing member and the bracket are both equipped with second air inlet holes, and the second air inlet holes are in communication with the second installation slots; a third air inlet hole in communication with the second air inlet holes is defined in the circuit board, and a fourth air inlet hole is defined in a bottom portion of the liquid passing chamber; the second air inlet holes, the third air inlet hole, the fourth air inlet holes, and an interior of the atomizing cores are in communication with each other;

the second sealing member, the bracket, and the bottom portion of the liquid passing chamber are all equipped with wiring holes.

10. The electronic cigarette of claim 9, wherein the circuit board is equipped with first position limiting columns, and the first position limiting columns are at least partially placed on the second sealing member;

the first position limiting columns are conductive columns, and the first position limiting columns pass through the wiring holes and then are electrically connected to the atomizing cores;

fifth air inlet holes are further defined in the second sealing member, and sixth air inlet holes are defined in the bracket; an upper end and a lower end of the fifth air inlet holes are respectively in communication with the sixth air inlet holes and the third air inlet hole, and the fifth air inlet holes are in communication with the fourth air inlet holes.

11. The electronic cigarette of claim 9, wherein the liquid passing chamber comprises a chamber body with openings at a bottom portion and a third sealing member arranged at the openings; the fourth air inlet holes are positioned on the third sealing member, the wiring holes penetrate through the third sealing member, bottom portions of the atomizing cores are connected to the third sealing member, and a bottom portion of the third sealing member is connected to the bracket; a fourth sealing member is arranged between top portions of the atomizing cores and the liquid passing chamber, both the fourth sealing member and a top portion of the liquid passing chamber are equipped with third aerosol outlet holes in communication with the second aerosol outlet holes, and the third aerosol outlet holes are in communication with an interior of the atomizing cores.

12. The electronic cigarette of claim 8, wherein a middle of a bottom portion of the position limiting panel is provided with a convex second position limiting column; a top portion of the body is equipped with a third installation slot, and the third installation slot is adapted to the position limiting panel; a fourth sealing member is arranged inside the body at a position near the mouthpiece, and a cavity is formed between the fourth sealing member and a top surface inside the body; a position limiting hole is defined in a bottom portion of the third installation slot, and the position limiting hole is in communication with the cavity; a position limiting member with a width greater than the position limiting hole is provided inside the cavity, an elastic member is arranged between the position limiting member and a top surface of the cavity, and the second position limiting column passes through the position limiting hole and then is connected to the position limiting member.

13. The electronic cigarette of claim 12, wherein a bottom portion of the position limiting panel is equipped with a first magnet, the third sealing member is embedded with second magnets on one side near the mouthpiece, and the second magnets are attracted with the first magnet.

14. The electronic cigarette of claim 1, wherein a first air exchange hole is defined in a top portion or near the top portion of the liquid tanks, and the first air exchange hole is in communication with the liquid passing chamber when the liquid tanks are installed in the installation cavities.

15. The electronic cigarette of claim 14, wherein a second joint structure is provided between the liquid tanks and the liquid passing chamber; the second joint structure comprises a third convex block and a fourth convex block placed inside the third convex block; and the fourth convex block is placed inside the third convex block when the liquid tanks are assembled into the installation cavities.

16. The electronic cigarette of claim 15, wherein the third convex block is positioned on the liquid tanks, the first air exchange hole penetrates through the third convex block, the fourth convex block is positioned on the liquid passing chamber, and a second air exchange hole in communication with the liquid passing chamber penetrates through the fourth convex block;

the third convex block is provided with a fifth sealing member for sealing the first air exchange hole.

17. The electronic cigarette of claim 16, wherein the fifth sealing member is made of rubber; the fifth sealing member comprises a second sealing ring sleeved on the third convex block and a second sealing panel covering the second sealing ring; the second sealing panel is provided with a second indentation, and an outer contour of the fourth convex block is smaller than a size of the first air exchange hole;

when the fourth convex block is placed inside the third convex block, the fourth convex block squeezes the second sealing panel, so that the second sealing panel is penetrated along the second indentation, achieving communication between the first air exchange hole and the second air exchange hole, and the second sealing panel is positioned between the third convex block and the fourth convex block.

18. The electronic cigarette of claim 2, wherein the liquid tanks comprise a tank body and a tank cover, the tank cover is connected to the tank body, and a third sealing member is provided between the tank cover and the tank body;

at least one fixing block is provided at a top portion and/or a bottom portion of the liquid tanks, and one side surface of the fixing block near the liquid outlet hole is at least partially inclined.

19. The electronic cigarette of claim 18, wherein the circuit board is equipped with a charging interface, the battery is a charging battery, and an avoidance opening is defined in the body at a position corresponding to the charging interface.

20. The electronic cigarette of claim 19, wherein the body comprises an upper cover body, an intermediate housing body, and a bottom housing; the upper cover body and the bottom housing are respectively connected to an upper end and a lower end of the intermediate housing body, the battery and the circuit board are arranged in the bottom housing, the atomizing cores are arranged in a middle of the intermediate housing body, the bottom housing is equipped with a display screen, the installation openings are defined in the intermediate housing body, and the charging interface is positioned on the bottom housing;

when the liquid tanks are assembled into the installation cavities, the fixing block is engaged with the intermediate housing body and placed inside the intermediate housing body.

* * * * *